US010266919B2

(12) United States Patent
Hardy et al.

(10) Patent No.: US 10,266,919 B2
(45) **Date of Patent: *Apr. 23, 2019**

(54) NICKEL-BASE SUPERALLOY

(71) Applicant: ROLLS-ROYCE PLC, London (GB)

(72) Inventors: Mark C Hardy, Derby (GB); Roger C Reed, Startford upon Avon (GB); David Crudden, Oxford (GB)

(73) Assignee: ROLLS-ROYCE plc, London (GB)

( * ) Notice: Subject to any disclaimer, the term of this patent is extended or adjusted under 35 U.S.C. 154(b) by 267 days.

This patent is subject to a terminal disclaimer.

(21) Appl. No.: 15/200,779

(22) Filed: Jul. 1, 2016

(65) Prior Publication Data

US 2017/0088919 A1 Mar. 30, 2017

(30) Foreign Application Priority Data

Jul. 3, 2015 (GB) ..... 1511684.1

(51) Int. Cl.

| | |
|---|---|
| ***C22C 19/05*** | (2006.01) |
| ***B22F 5/00*** | (2006.01) |
| ***F01D 5/02*** | (2006.01) |
| ***F01D 25/24*** | (2006.01) |
| ***F04D 29/32*** | (2006.01) |
| ***F23R 3/00*** | (2006.01) |

(52) U.S. Cl.

CPC ..... *C22C 19/056* (2013.01); *C22C 19/05* (2013.01); *F01D 5/02* (2013.01); *F01D 25/24* (2013.01); *F04D 29/321* (2013.01); *F23R 3/002* (2013.01); *F05D 2220/32* (2013.01); *F05D 2300/175* (2013.01); *F05D 2300/177* (2013.01)

(58) Field of Classification Search

CPC .... B22F 2301/15; B22F 5/009; C22C 19/056; C22C 19/05; C22C 19/058; C22C 19/00; C22C 1/0433

USPC ..... 420/442, 445–452; 428/652

See application file for complete search history.

(56) References Cited

U.S. PATENT DOCUMENTS

| | | | | |
|---|---|---|---|---|
| 2,948,606 A | | 8/1960 | Thielemann | |
| 3,459,545 A | | 8/1969 | Bieber et al. | |
| 3,677,747 A | * | 7/1972 | Lund et al. | C22C 19/056 420/448 |
| 4,161,412 A | * | 7/1979 | Henry | C30B 33/00 148/404 |

(Continued)

FOREIGN PATENT DOCUMENTS

| | | |
|---|---|---|
| EP | 1193321 A1 | 4/2002 |
| EP | 1195446 A1 | 4/2002 |

(Continued)

OTHER PUBLICATIONS

Nov. 17, 2016 Extended Search Report issued in European Patent Application No. 16177287.6.

(Continued)

*Primary Examiner* — Matthew E. Hoban
*Assistant Examiner* — Lynne Edmondson
(74) *Attorney, Agent, or Firm* — Oliff PLC

(57) ABSTRACT

A nickel-base superalloy that includes 6.55% to 7.15% aluminum, 3.3% to 3.7% titanium, 1.2% to 1.7% tantalum, and 0.8% to 1.0% niobium, such that a combined atomic percentage of the aluminum, the titanium, the tantalum and the niobium is between 12.65% and 13.15% to provide substantially 51% to 53% by volume of gamma prime precipitates.

4 Claims, 8 Drawing Sheets

20

| at.% | Ni | Co | Cr | Fe | Mn | Mo | W | Al | Ti | Ta | Nb | Si | C | B | Zr | Hf | |
|---|---|---|---|---|---|---|---|---|---|---|---|---|---|---|---|---|---|
| A | Bal | 15.55 | 14.0 | 1.1 | 0.60 | 1.40 | 1.15 | 6.85 | 3.50 | 1.60 | 0.90 | 0.50 | 0.15 | 0.13 | 0.06 | 0.000 | 22 |
| B | Bal | 15.40 | 14.0 | 1.1 | 0.60 | 1.40 | 1.15 | 7.00 | 3.60 | 1.20 | 1.00 | 0.50 | 0.15 | 0.13 | 0.06 | 0.000 | 24 |
| C | Bal | 15.00 | 14.2 | 1.0 | 0.50 | 1.30 | 1.10 | 6.90 | 3.50 | 1.55 | 0.90 | 1.00 | 0.13 | 0.12 | 0.04 | 0.000 | 26 |

18

(56) References Cited

U.S. PATENT DOCUMENTS

| | | | | |
|---|---|---|---|---|
| 4,569,824 | A | 2/1986 | Duhl et al. | |
| 5,476,555 | A | 12/1995 | Erickson | |
| 5,637,159 | A | 6/1997 | Erickson | |
| 5,888,316 | A | 3/1999 | Erickson | |
| 6,132,527 | A | 10/2000 | Hessell et al. | |
| 6,468,368 | B1 | 10/2002 | Merrick et al. | |
| 6,969,431 | B2 | 11/2005 | Hieber et al. | |
| 6,974,508 | B1 | 12/2005 | Gabb et al. | |
| 8,083,872 | B2 | 12/2011 | Mitchell et al. | |
| 8,409,722 | B2 | 4/2013 | Torigoe et al. | |
| 8,613,810 | B2 | 12/2013 | Mourer et al. | |
| 8,734,716 | B2 | 5/2014 | Harada et al. | |
| 8,992,699 | B2 | 3/2015 | Bain et al. | |
| 2003/0047251 | A1 | 3/2003 | Caron et al. | |
| 2004/0221925 | A1* | 11/2004 | Tamaki | C22C 19/056 148/410 |
| 2004/0261921 | A1 | 12/2004 | Nazmy | |
| 2005/0047954 | A1 | 3/2005 | Hieber et al. | |
| 2006/0174482 | A1 | 8/2006 | Roedl et al. | |
| 2007/0227630 | A1 | 10/2007 | Lecallier et al. | |
| 2008/0026570 | A1 | 1/2008 | Kim et al. | |
| 2008/0101981 | A1* | 5/2008 | Arrell | C22C 19/055 420/443 |
| 2010/0008778 | A1* | 1/2010 | Patrick | F01D 5/26 416/144 |
| 2010/0080729 | A1 | 4/2010 | Biondo et al. | |
| 2010/0303665 | A1* | 12/2010 | Bain | C22C 1/0433 420/448 |
| 2010/0303666 | A1 | 12/2010 | Bain et al. | |
| 2010/0329876 | A1 | 12/2010 | Bain et al. | |
| 2011/0194971 | A1 | 8/2011 | Harada et al. | |
| 2011/0203707 | A1 | 8/2011 | Mourer et al. | |
| 2012/0269646 | A1 | 10/2012 | Mitchell et al. | |
| 2012/0273093 | A1* | 11/2012 | Hanlon | B22D 27/045 148/555 |
| 2012/0279351 | A1 | 11/2012 | Gu et al. | |
| 2013/0167687 | A1 | 7/2013 | Gu et al. | |
| 2015/0192022 | A1 | 7/2015 | Reed et al. | |

FOREIGN PATENT DOCUMENTS

| | | | |
|---|---|---|---|
| EP | 1201777 | A1 | 5/2002 |
| EP | 2045345 | A1 | 4/2009 |
| EP | 2256223 | A1 | 12/2010 |
| EP | 2281907 | A1 | 2/2011 |
| EP | 2407565 | A1 | 1/2012 |
| EP | 2 602 336 | A1 | 6/2013 |
| EP | 3042973 | A1 | 7/2016 |
| GB | 990022 | A | 4/1965 |
| GB | 2152076 | A | 7/1985 |
| JP | 2000063969 | A | 2/2000 |
| SU | 426537 | A1 | 12/1976 |
| WO | 2012/047352 | A2 | 4/2012 |
| WO | 2014/157144 | A1 | 10/2014 |

OTHER PUBLICATIONS

U.S. Appl. No. 14/966,564, filed Dec. 11, 2015 in the name of Mark C. Hardy.

May 20, 2016 Search Report issued in European Patent Application No. 15 19 9133.

Jul. 1, 2014 Search Report issued in British Patent Application No. GB 1400352.9.

May 22, 2015 Search Report issued in European Patent Application No. 14198811.

Apr. 15, 2016 Search Report issued in British Patent Application No. 1511684.1.

Jan. 5, 2018 Office Action issued in U.S. Appl. No. 14/577,422.

U.S. Appl. No. 14/577,422, filed Dec. 19, 2014 in the name of Roger Reed et al.

Sep. 18, 2015 Search Report issued in British Patent Application No. 1500177.9.

Mignanelli et al., "The influence of Al:Nb ratio on the microstructure and mechanical response of quaternary Ni—Cr—Al—Nb alloys," Materials Science & Engineering A, vol. 612, 2014, pp. 179-186.

Stephens et al., "Understanding the Roles of the Strategic Element Cobalt in Nickel Base Superalloys," Prepared for the Materials Substitution and Recycling Meeting, Vimerio, Portugal, Oct. 10-14, 1983, NASA Tech. Memo. 83475.

Apr. 27, 2018 Office Action issued in U.S. Appl. No. 14/966,564.

Dec. 5, 2018 Office Action issued in U.S. Appl. No. 15/946,170.

Oct. 25, 2018 Office Action Issued in U.S. Appl. No. 14/577,422.

* cited by examiner

12

| wt.% | Ni | Co | Cr | Fe | Mn | Mo | W | Al | Ti | Ta | Nb | Si | C | B | Zr | Hf |
|---|---|---|---|---|---|---|---|---|---|---|---|---|---|---|---|---|
| min. | Bal | 14.6 | 11.5 | 0.8 | 0.20 | 2.00 | 3.30 | 2.90 | 2.60 | 3.50 | 1.20 | 0.10 | 0.02 | 0.010 | 0.05 | 0.000 |
| max. | Bal | 15.9 | 13.0 | 1.2 | 0.60 | 2.40 | 3.70 | 3.30 | 3.10 | 5.10 | 1.80 | 0.60 | 0.06 | 0.030 | 0.11 | 0.045 |

14 16

10

FIG. 1

20

| at.% | Ni | Co | Cr | Fe | Mn | Mo | W | Al | Ti | Ta | Nb | Si | C | B | Zr | Hf |
|---|---|---|---|---|---|---|---|---|---|---|---|---|---|---|---|---|
| A | Bal | 15.55 | 14.0 | 1.1 | 0.60 | 1.40 | 1.15 | 6.85 | 3.50 | 1.60 | 0.90 | 0.50 | 0.15 | 0.13 | 0.06 | 0.000 |
| B | Bal | 15.40 | 14.0 | 1.1 | 0.60 | 1.40 | 1.15 | 7.00 | 3.60 | 1.20 | 1.00 | 0.50 | 0.15 | 0.13 | 0.06 | 0.000 |
| C | Bal | 15.00 | 14.2 | 1.0 | 0.50 | 1.30 | 1.10 | 6.90 | 3.50 | 1.55 | 0.90 | 1.00 | 0.13 | 0.12 | 0.04 | 0.000 |

22 24 26

18

FIG. 2A

30

| wt.% | Ni | Co | Cr | Fe | Mn | Mo | W | Al | Ti | Ta | Nb | Si | C | B | Zr | Hf |
|---|---|---|---|---|---|---|---|---|---|---|---|---|---|---|---|---|
| A | Bal | 15.50 | 12.3 | 1.0 | 0.55 | 2.3 | 3.6 | 3.1 | 2.8 | 4.9 | 1.4 | 0.25 | 0.03 | 0.025 | 0.09 | 0.000 |
| B | Bal | 15.50 | 12.4 | 1.0 | 0.55 | 2.3 | 3.6 | 3.2 | 2.9 | 3.7 | 1.6 | 0.25 | 0.03 | 0.025 | 0.09 | 0.000 |
| C | Bal | 15.00 | 12.6 | 0.9 | 0.50 | 2.1 | 3.4 | 3.2 | 2.8 | 4.8 | 1.4 | 0.50 | 0.03 | 0.020 | 0.06 | 0.000 |

32 34 36

28

FIG. 2B 40 40 40 40 40 40

| Alloy | % γ' formers | % η' formers | density ($g.cm^{-3}$) | Δσ (MPa) | Cr/Ti (at.%) | Cr/(Mo+W) (at.%) |
|---|---|---|---|---|---|---|
| A | 12.85 | 6.0 | 8.50 | 216 | 4.0 | 5.5 |
| B | 12.80 | 5.8 | 8.42 | 217 | 3.9 | 5.5 |
| C | 12.85 | 6.0 | 8.45 | 214 | 4.1 | 5.9 |
| RR1000 | 11.28 | 4.9 | 8.21 | 230 | 3.8 | 5.5 |

42 44 46 48

38

FIG. 3

| Feature | CG RR1000 | Alloy C |
|---|---|---|
| Scale | 5.8 (±1.2) μm | 2.4 (±0.3) μm |
| Internal oxide | 13.7 (±1.6) μm | 4.9 (±1.0) μm |

86

FIG. 7

NICKEL-BASE SUPERALLOY

TECHNOLOGICAL FIELD

The present disclosure concerns a nickel-base superalloy.

BACKGROUND

Improvements in alloys may enable disc rotors in gas turbine engines, such as those in the high pressure (HP) compressor and turbine, to operate at higher compressor outlet temperatures and faster shaft speeds. These properties may facilitate high climb rates that are increasingly required by commercial airlines to move aircraft more quickly to altitude, to reduce fuel burn, and to get the aircraft away from busy air spaces around airports.

The above mentioned operating conditions may give rise to fatigue cycles with long dwell periods at elevated temperatures, in which oxidation and time dependent deformation significantly influence the resistance to low cycle fatigue. As a result, it would be desirable to improve the resistance of alloys to dwell fatigue or time dependent crack growth and surface environmental damage, and to increase proof strength, without compromising their other mechanical and physical properties or increasing their density and cost.

Current alloys cannot provide the balance of properties needed for such operating conditions. Many are claimed to show excellent creep resistance, high temperature yield strength and damage tolerance under dwell cycles at temperatures in the range of 600° C. to 760° C. as well as microstructural stability. However, their resistance to environmental damage, particularly hot corrosion resistance is not optimised. Many prior alloys show high density (close to or exceeding 8.5 $g \cdot cm^{-3}$) and are expensive, given the high levels of tantalum.

Current nickel base alloys have compromised resistance to surface environmental degradation (oxidation and type II hot corrosion) in order to achieve improved high temperature strength and resistance to creep strain accumulation, and in order to achieve stable bulk material microstructures (to prevent the precipitation of detrimental topologically close-packed phases). Disc rotors in the High Pressure (HP) section are commonly exposed to temperatures above 650° C., and in future engine designs will be exposed to temperatures above 730° C. As disc temperatures continue to increase, hot corrosion and oxidation damage will begin to limit disc life. Without suitable alloys, environmental protection will need to be applied to such discs, which may be undesirable and technically very difficult.

BRIEF SUMMARY

According to various, but not necessarily all, embodiments there is provided a nickel-base superalloy consisting of, by weight: 14.6% to 15.9% cobalt; 11.5% to 13.0% chromium; 0.8% to 1.2% iron; 0.20% to 0.60% manganese; 2.00% to 2.40% molybdenum; 3.30% to 3.70% tungsten; 2.90% to 3.30% aluminium; 2.60% to 3.10% titanium; 3.50% to 5.10% tantalum; 1.20% to 1.80% niobium; 0.10% to 0.60% silicon; 0.02% to 0.06% carbon; 0.010% to 0.030% boron; 0.05% to 0.11% zirconium; up to 0.045% hafnium; and the balance being nickel and impurities.

The nickel-base superalloy may consist of, by weight: 15.50% cobalt; 12.3% chromium; 1.0% iron; 0.55% manganese; 2.3% molybdenum; 3.6% tungsten; 3.1% aluminium; 2.8% titanium; 4.9% tantalum; 1.4% niobium; 0.25% silicon; 0.03% carbon; 0.025% boron; 0.09% zirconium; and the balance being nickel and impurities.

The nickel-base superalloy may consist of, by weight: 15.50% cobalt; 12.4% chromium; 1.0% iron; 0.55% manganese; 2.3% molybdenum; 3.6% tungsten; 3.2% aluminium; 2.9% titanium; 3.7% tantalum; 1.6% niobium; 0.25% silicon; 0.03% carbon; 0.025% boron; 0.09% zirconium; and the balance being nickel and impurities.

The nickel-base superalloy may consist of, by weight: 15.00% cobalt; 12.6% chromium; 0.9% iron; 0.50% manganese; 2.1% molybdenum; 3.4% tungsten; 3.2% aluminium; 2.8% titanium; 4.8% tantalum; 1.4% niobium; 0.50% silicon; 0.03% carbon; 0.020% boron; 0.06% zirconium; and the balance being nickel and impurities.

The impurities may comprise less than twenty parts per million of sulphur, and less than sixty parts per million of phosphorus.

The impurities may comprise less than five parts per million of sulphur, and less than twenty parts per million of phosphorus.

According to various, but not necessarily all, embodiments there is provided a nickel-base superalloy comprising: aluminium, titanium, tantalum and niobium having a combined atomic percentage between 12.65% and 13.15% to provide substantially 51% to 53% by volume of gamma prime precipitates.

The titanium, tantalum, and the niobium may have a combined atomic percentage of less than 6.2% to reduce eta precipitation.

The titanium, tantalum, and the niobium may have a combined atomic percentage of less than 6.0% to reduce eta precipitation.

The nickel-base superalloy may comprise, by atomic percentage: 6.55% to 7.15% aluminium; 3.3% to 3.7% titanium; 1.2% to 1.7% tantalum; and 0.8% to 1.0% niobium.

According to various, but not necessarily all, embodiments there is provided a component of a gas turbine engine comprising a nickel-base superalloy as described in any of the preceding paragraphs.

According to various, but not necessarily all, embodiments there is provided a gas turbine engine comprising a nickel-base superalloy as described in any of the preceding paragraphs.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION

Embodiments will now be described by way of example only, with reference to the Figures, in which:

FIG. 1 illustrates a table of weight percentages for chemical elements of nickel-base superalloys according to various examples;

FIG. 2A illustrates a table of atomic percentages for chemical elements of three nickel-base superalloys: A, B, C;

FIG. 2B illustrates a table of weight percentages for chemical elements of the three nickel-base superalloys: A, B, C;

FIG. 3 illustrates a table of alloy properties for the three nickel-base superalloys: A, B, C;

FIG. 7 illustrates a table of oxidation damage parameters for alloy RR1000 and alloy C;

DETAILED DESCRIPTION

Figure 4:
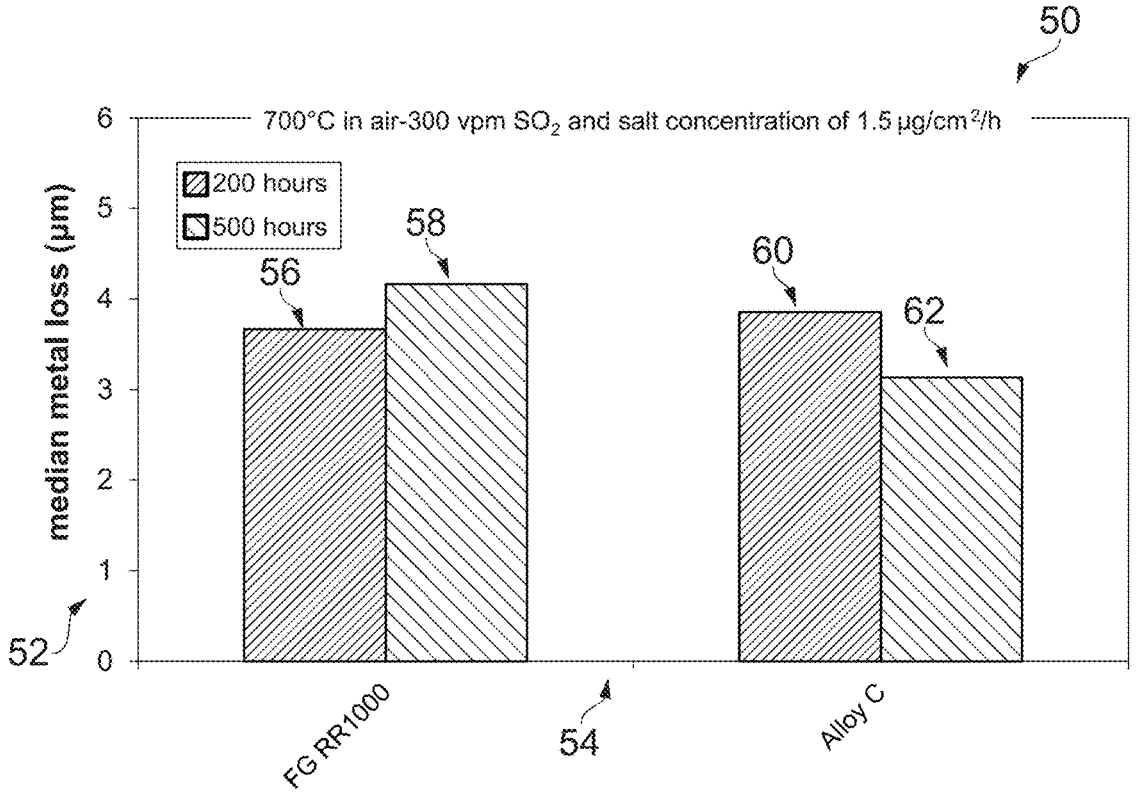
FIG. 4 illustrates a graph of median metal loss for alloy C and alloy RR1000.

FIG. 1 illustrates a table 10 of minimum and maximum weight percentages for chemical elements of nickel-base superalloys according to various examples. The nickel-base superalloys comprise a disordered face-centred cubic gamma phase that is precipitation strengthened by an ordered $L1_2$ gamma prime phase. Gamma prime is described by $Ni_3X$ where X is predominantly aluminium (Al) with progressively smaller proportions of titanium (Ti), tantalum (Ta) and niobium (Nb). About fifty one percent to fifty three percent by volume of gamma prime precipitates may produce the required balance of high temperature properties. This is achieved by additions of aluminium (Al), titanium (Ti), tantalum (Ta) and niobium (Nb) according to:

$$13.15 \text{ atomic } \% > Al+Ti+Ta+Nb > 12.65 \text{ atomic } \% \quad \text{(Equation 1)}$$

Where Al=6.55 to 7.15 atomic %, Ti=3.3 to 3.7 atomic %, Ta=1.2 to 1.7 atomic % and Nb=0.8-1.0 atomic %. These are nominal composition ranges that do not include permitted ranges for material specification. The latter are shown in Table 10 of FIG. 1.

With large concentrations of Ti, Ta and Nb, there is a risk of eta precipitation, which may be undesirable. Eta phase precipitation occurs over a narrow range of temperatures if the material receives just a thermal excursion. If strain is applied, eta can form during hot isostatic pressing (HIP) or forging if these operations are undertaken at a susceptible temperature. Similarly, eta precipitation may occur at the surface of disc rotors during exposure to temperatures between seven hundred and eight hundred degrees Celsius as a result of strain from shot peening.

To avoid eta precipitation in circumstances that are free of strain:

$$Ti+Ta+Nb < 6.2 \text{ atomic } \% \quad \text{(Equation 2)}$$

In some examples:

$$Ti+Ta+Nb < 6 \text{ atomic } \% \quad \text{(Equation 3)}$$

These levels of Al, Ti, Ta and Nb have been specified to produce the compositions and attributes in the tables illustrated in FIGS. 1, 2A, 2B and 3.

In more detail, the table 10 comprises a plurality of columns 12 for the chemical elements: nickel; cobalt; chromium; iron; manganese; molybdenum; tungsten; aluminium; titanium; tantalum; niobium; silicon; carbon; boron, zirconium and hafnium. The table 10 also comprises a first row 14 for the minimum weight percentage of each of the chemical elements, and a second row 16 for the maximum weight percentage of each of the chemical elements.

The nickel-base superalloys consist of, by weight: 14.6% to 15.9% cobalt; 11.5% to 13.0% chromium; 0.8% to 1.2% iron; 0.2% to 0.60% manganese; 2.00% to 2.40% molybdenum; 3.30% to 3.70% tungsten; 2.90% to 3.30% aluminium; 2.60% to 3.10% titanium; 3.50% to 5.10% tantalum; 1.20% to 1.80% niobium; 0.10% to 0.60% silicon; 0.02% to 0.06% carbon; 0.010% to 0.030% boron; 0.05% to 0.11% zirconium; 0.000% to 0.045% hafnium; and the balance being nickel and impurities.

FIG. 2A illustrates a table 18 of atomic percentages for chemical elements of nickel-base superalloys A, B and C. The table 18 comprises a plurality of columns 20 for the chemical elements: nickel; cobalt; chromium; iron; manganese; molybdenum; tungsten; aluminium; titanium; tantalum; niobium; silicon; carbon; boron, zirconium and hafnium. The table 18 also comprises a first row 22 for nickel-base superalloy A, a second row 24 for nickel-base superalloy B, and a third row 26 for nickel-base superalloy C.

Nickel-base superalloy A consists of, in atomic percentage: 15.55% cobalt; 14.0% chromium; 1.1% iron; 0.60% manganese; 1.40% molybdenum; 1.15% tungsten; 6.85% aluminium; 3.50% titanium; 1.60% tantalum; 0.90% niobium; 0.50% silicon; 0.15% carbon; 0.13% boron; 0.06% zirconium, the balance being nickel and impurities.

Nickel-base superalloy B consists of, in atomic percentage: 15.40% cobalt; 14.0% chromium; 1.1% iron; 0.60% manganese; 1.40% molybdenum; 1.15% tungsten; 7.00% aluminium; 3.60% titanium; 1.20% tantalum; 1.00% niobium; 0.50% silicon; 0.15% carbon; 0.13% boron; 0.06% zirconium, the balance being nickel and impurities.

Nickel-base superalloy C consists of, in atomic percentage: 15.00% cobalt; 14.2% chromium; 1.0% iron; 0.50% manganese; 1.30% molybdenum; 1.10% tungsten; 6.90% aluminium; 3.50% titanium; 1.55% tantalum; 0.90% niobium; 1.00% silicon; 0.13% carbon; 0.12% boron; 0.04% zirconium, the balance being nickel and impurities.

FIG. 2B illustrates a table 28 of weight percentages for chemical elements of the nickel-base superalloys A, B and C. The table 28 comprises a plurality of columns 30 for the chemical elements: nickel; cobalt; chromium; iron; manganese; molybdenum; tungsten; aluminium; titanium; tantalum; niobium; silicon; carbon; boron, zirconium and hafnium. The table 28 also comprises a first row 32 for nickel-base superalloy A, a second row 34 for nickel-base superalloy B, and a third row 36 for nickel-base superalloy C.

Nickel-base superalloy A consists of, by weight: 15.50% cobalt; 12.3% chromium; 1.0% iron; 0.55% manganese; 2.3% molybdenum; 3.6% tungsten; 3.1% aluminium; 2.8% titanium; 4.9% tantalum; 1.4% niobium; 0.25% silicon; 0.03% carbon; 0.025% boron; 0.09% zirconium; and the balance being nickel and impurities.

Nickel-base superalloy B consists of, by weight: 15.50% cobalt; 12.4% chromium; 1.0% iron; 0.55% manganese; 2.3% molybdenum; 3.6% tungsten; 3.2% aluminium; 2.9% titanium; 3.7% tantalum; 1.6% niobium; 0.25% silicon; 0.03% carbon; 0.025% boron; 0.09% zirconium; the balance being nickel and impurities.

Nickel-base superalloy C consists of, by weight: 15.00% cobalt; 12.6% chromium; 0.9% iron; 0.50% manganese; 2.1% molybdenum; 3.4% tungsten; 3.2% aluminium; 2.8% titanium; 4.8% tantalum; 1.4% niobium; 0.50% silicon; 0.03% carbon; 0.020% boron; 0.06% zirconium; the balance being nickel and impurities.

In some examples, the nickel-base superalloys mentioned above and whose compositions are illustrated in FIGS. 1, 2A and 2B may comprise less than twenty parts per million of sulphur, and less than sixty parts per million of phosphorus as impurities. In further examples, the nickel-base superalloys may comprise less than five parts per million of sulphur, and less than twenty parts per million of phosphorus as impurities.

The quantities of the alloy additions in the tables illustrated in FIGS. 1, 2A and 2B have been specified to produce specific effects and these are described below for each of the chemical elements.

Aluminium

Aluminium provides the largest concentration of the elements in equation 1 above to gamma prime and as such, has the most significant effect on gamma prime solvus temperature. Solution heat treatment of forgings is necessary above this temperature to produce the required grain size for optimised resistance to time dependent crack growth. The solvus temperature is limited to temperatures below 1165° C. to minimise incipient melting, grain boundary B liquidation and loss of ductility in the alloy, which can give rise to intergranular cracking during quenching of forgings. Aluminium levels therefore provide high volume fractions of gamma prime but an upper value is specified to enable forgings to be manufactured. Replacing aluminium atoms in gamma prime with titanium, tantalum and niobium offers improved levels of yield strength.

Titanium

Whilst additions of titanium offer improved levels of yield strength, they are limited to: (i) ensure eta phase is not formed, in combination with tantalum and niobium, according to equation 2; (ii) minimise the instability of primary MC carbides that can decompose to grain boundary $M_{23}C_6$ carbides at temperatures above 700° C. (see equation 3 below); and (iii) to minimise the formation of rutile ($TiO_2$) from exposure of the alloy at high temperature in service.

$$MC+\gamma \rightarrow M_{23}C_6+\gamma' \quad \text{(Equation 4)}$$

Titanium gives rise to rutile nodules that form above $Cr_2O_3$ (chromia) nodules in the surface oxide scale. The source of titanium for the surface rutile nodules is gamma prime, and with the loss of Al from gamma prime for sub-surface alumina "fingers", a region free of gamma prime is produced during prolonged high temperature exposure. It is considered that this gamma prime free region shows significantly reduced material properties compared to the base alloy and is likely to crack under fatigue loading and conditions that lead to the accumulation of inelastic strain. The presence of titanium is detrimental as it significantly reduces the potency of the chromia scale, which by itself is a protective oxide. As such, the resistance to oxidation damage can be correlated, at least to a first approximation, to chromium/titanium ratio in atomic %. Applying this rule allows an alloy composition to be defined that shows improved oxidation resistance compared to current alloys that show higher levels of chromium, that is, the higher the chromium/titanium ratio, the better the oxidation resistance.

Chromium

Chromium is required for resistance to surface hot corrosion and oxidation damage. Of these forms of environmental attack, hot corrosion is the most damaging but is localised to surfaces that show ingested $Na_2SO_4$, NaCl rich deposits and is most detrimental between 650-750° C., particularly 700° C. Oxidation is less damaging but is ubiquitous. To minimise environmental damage (from oxidation and hot corrosion), levels of chromium above 20 wt. % are preferred. However, such high concentrations of chromium cannot be added to alloys that precipitate high % of gamma prime, such as the nickel-base superalloys disclosed herein, as they would form detrimental topologically closed packed (TCP) phases such as a C14 hexagonal Laves phases (rich in molybdenum, tungsten, chromium), sigma (σ) ($(Ni, Co,Fe)_x(Cr, Mo,W)_y$ where x and y can vary between 1 and 7) or mu (μ) ($(Ni,Co,Fe)_7(Cr,Mo,W)_6$) during high temperature exposure. Since these unwanted phases decorate grain boundaries, they have a deleterious effect on high temperature properties, particularly ductility, stress rupture and dwell crack growth resistance.

In addition to the correlation for oxidation resistance above, to a first approximation, resistance to type II hot corrosion damage can be correlated to Cr/(Mo+W) ratio since molybdenum and tungsten both produce detrimental acidic oxides.

Molybdenum and Tungsten

Molybdenum and tungsten are added as they partition to, and strengthen the gamma phase by substitutional solid solution strengthening. As they are larger atoms than nickel atoms that they replace, they are potent solid solution strengthening elements. Molybdenum is particularly effective as a higher proportion of the quantity added partitions to the gamma phase, unlike tungsten, which partitions in higher concentrations to gamma prime. Tungsten also has a more detrimental effect on increasing alloy density. However, the molybdenum content is limited, as with chromium content, as it promotes the formation of TCP phases. Molybdenum is therefore specified at a level, which provides optimised gamma strength and lattice parameter size without producing intolerable levels of TCP phases in service.

The additions of molybdenum and tungsten are also beneficial to the gamma phase in terms of their effects on the lattice parameter. As they are large atoms, they increase the lattice parameter of gamma ($a_\gamma$). This is important as the lattice parameter of gamma prime ($a_{\gamma'}$) also increases as a result of additions of tantalum and niobium. It is advantageous that the misfit (δ), see equation 5, between the gamma and gamma prime phases is minimised or negative at temperatures between 700 and 800° C. as this minimises the rate of coarsening of tertiary gamma prime particles, the presence and size of which strongly effect high temperature strength, creep and time dependent crack growth behaviour.

$$\delta = \frac{2(a_{\gamma'} - a_\gamma)}{a_\gamma + a_{\gamma'}} \quad \text{(Equation 5)}$$

Tantalum and Niobium

The contribution of niobium and tantalum to gamma prime is advantageous as these elements show slower rates of diffusion in nickel compared to aluminium and titanium, which is significant during quenching of forgings and high temperature operation in terms of reducing the rate of coarsening of secondary and tertiary gamma prime respectively, and in terms of resistance to oxidation damage since aluminium and titanium readily migrate from gamma prime to form oxidation products.

Sufficient quantities of tantalum and niobium are added to develop stable primary MC carbides (where M can represent Ti, Ta or Nb). Equation 4 shows that MC carbides can decompose at lower temperatures to $M_{23}C_6$ carbides. These $M_{23}C_6$ carbides form as films or elongated particles on grain boundaries and can reduce creep stress rupture life if extensive films decorate grain boundaries. The formation of $M_{23}C_6$ carbides may remove chromium from the gamma phase adjacent to the grain boundary, and therefore reduces the resistance to oxidation in this region. If thermal and fatigue loading conditions do not give rise to fatigue cracks, then chromium from near-surface $M_{23}C_6$ carbides can diffuse along grain boundaries towards the surface, leaving voids. These voids are a form of internal oxidation damage, which can reduce the resistance of the alloy to fatigue crack nucleation. Sigma (σ) phase can form preferentially on existing $M_{23}C_6$ carbides, which suggests that alloy stability can be improved by adding tantalum and niobium.

Unlike titanium and niobium (see later discussion), tantalum may not be detrimental to oxidation resistance and has been shown to improve time dependent crack growth resistance. The negative impact of adding higher levels of tantalum is increasing density and cost. Currently, tantalum is the second most expensive element in the proposed compositions (after hafnium) and can be subject to fluctuations in price as it is used heavily in micro-electronics.

The effect of niobium on dwell crack growth behaviour of nickel disc alloys can vary significantly. Firstly, evidence for cast and wrought alloys shows that niobium is detrimental to dwell crack growth as a result of the oxidation of large blocky MC carbides and delta (δ), $Ni_3Nb$, phase, which reside on grain boundaries and form brittle $Nb_2O_5$. A small fraction of the available niobium partitions to the gamma phase and may segregate to grain boundaries in material ahead of a growing crack as a result of chromium depletion from the gamma phase as chromia forms from exposure to oxygen. Oxygen diffusion along grain boundaries is accelerated as a result of stress, particularly in material ahead of a crack tip during dwell fatigue cycles. The formation of $Nb_2O_5$ may be particularly detrimental as it produces a large volume change, as indicated by the Pilling-Bedworth Ratio of 2.5, and readily cracks or spalls.

The effect of niobium (up to about 1.7 wt. %) on dwell crack growth behaviour is less important than microstructural effects such as grain size and size of gamma prime particles. As powder metallurgy may be used to produce the above mentioned compositions, niobium levels of up to 1.8 wt. % have been added in the alloys in tables 10, 18, 28 illustrated in FIGS. 1, 2A & 2B respectively.

Cobalt

Cobalt has beneficial effects in lowering the solvus temperature and improves material properties. However, high levels of cobalt may produce non-optimised resistance to hot corrosion and may increase the cost of the alloy.

Cobalt is beneficial in lowering stacking fault energy of the gamma phase and in promoting annealing twins. This first aspect of lowering stacking fault energy is advantageous, particularly for solid solution strengthening, since the ability of dislocations to climb over gamma prime particles is made more difficult if the length of the stacking fault between partial dislocations increases as a result of a lower stacking fault energy. This produces an improvement in creep resistance of the alloy. The number of annealing twins may increase with lower stacking fault energy, which is beneficial as these are high angle boundaries that reduce the effective length of persistent slip bands (PSBs) that give rise to fatigue crack nucleation at temperatures below 650° C. Since PSBs are the dominant damage mechanism for fatigue crack nucleation at these temperatures, increasing the number of annealing twins may improve fatigue performance.

An upper limit of 1165° C. is proposed for the gamma prime solvus temperature to avoid quench cracking following solution heat treatment above the alloy gamma prime solvus temperature (super-solvus). It is beneficial therefore to minimise the gamma prime solvus temperature and maximise the temperature difference between this and the solidus temperature of the alloy. Increasing cobalt content reduces gamma prime solvus temperature, particularly if aluminium and titanium levels are also carefully selected.

A further, less established benefit of cobalt is its ability to influence the size and shape of secondary or quenching gamma prime precipitates, particularly those in intergranular locations. For a given cooling rate from super-solvus solution heat treatment, increasing cobalt content reduces the size of secondary gamma prime precipitates. Increasing cobalt content may also retard the deviation from a spherical morphology at slower cooling rates.

High levels of cobalt (in excess of 16 wt. %) may produce non-optimised resistance to hot corrosion resistance.

Silicon

At low level additions (<0.6 wt. %), silicon is considered to be beneficial to the alloys described above as it reduces gamma prime solvus temperature. However, it may also reduce the solidus temperature, and may produce local incipient melting at temperatures approaching the solidus temperature. Equally, the amount of silicon added is limited as it promotes the formation of TCP phases, notably σ. The preference is to add silicon at levels of 0.25 wt. % or less.

Manganese

Manganese, at levels of 0.2-0.6 wt. %, may improve hot corrosion resistance at temperatures between 650-760° C. and creep properties of polycrystalline nickel alloys, which contain 12-20 wt. % of chromium. The beneficial effects of manganese can be attributed to its ability to scavenge sulphur and form high melting point sulphides. This reduces the available sulphur in the alloy that can form low melting point $Ni_3S_2$, which produce high temperature grain boundary embrittlement of Ni—Cr alloys.

Sulphur and Phosphorus

Reduced sulphur levels improve hot ductility of Ni and Ni—Cr alloys. Impurities such as sulphur and phosphorus should be minimised to promote good grain boundary strength and mechanical integrity of oxide scales. As mentioned above, the alloys in tables 10, 18, 28 may have levels of sulphur and phosphorus of less than 5 and 20 ppm respectively. In some examples, the alloys in tables 10, 18, 28 may have a level of sulphur that is less than 20 ppm, and a level of phosphorus of less than 60 ppm.

Zirconium and Boron

Additions of zirconium in the region of 0.05-0.11 wt. % and of boron in the region of 0.01-0.03 wt. % may optimise the resistance to intergranular crack growth from high temperature dwell fatigue cycles. For both cast and forged polycrystalline superalloys for gas turbine applications, zirconium provides improved high temperature tensile ductility and strength, creep life and rupture strength. Zirconium has an affinity for oxygen and sulphur and scavenges these elements, thereby limiting the potential of oxygen and sulphur to reduce grain boundary cohesion.

The benefits of boron may be in improving grain boundary cohesion rather than the formation of grain boundary $M_3B_2$ borides (where M=Mo or W). However, boron can be detrimental if added in sufficient quantities as it reduces the melting temperature of Ni such that grain boundary films can form, particularly if high solution heat treatment temperatures are required. In the above described alloys, boron is specified to an upper limit of 0.03 wt. %.

Iron

Iron is intentionally added to the above described alloys at a level of about 1 at. % to enable solid scrap from powder billet (which is produced using a stainless steel container) and machining chips to be included in alloy manufacture. Such levels of iron can be tolerated, in terms of alloy stability, and may reduce material costs.

Carbon

The level of carbon in the above described alloys is between 0.02 and 0.06 wt. %. A value of about 0.03 wt. % is preferred as it minimises the presence of $M_{23}C_6$ carbides that may form during high temperature exposure and produce possible internal oxidation damage, which arises from their decomposition. However, this level of carbon is not as effective as 0.05 wt. % in controlling grain growth through grain boundary pinning during super-solvus solution heat treatment. The higher concentration of carbon may produce a smaller average grain size and a narrow grain size distribution, with lower values for isolated grains that determine the upper end of the grain size distribution. This is significant as yield stress and fatigue endurance at intermediate temperatures (<650° C.) are highly sensitive to grain size.

Hafnium

The level of hafnium in the above described alloys is between 0.000% and 0.045%. The addition of hafnium is beneficial as it scavenges S, like Zr and Mn, and therefore improves grain boundary ductility and strength.

FIG. 3 illustrates a table 38 of alloy properties for the three nickel-base superalloys: A, B, C, and also for alloy RR1000 (an existing Rolls-Royce alloy having a composition consisting of (in weight %): 18.5% of Cobalt; 15% Chromium; 5% Molybdenum; 3% Aluminium; 3.6% Titanium; 2% Tantalum; 0.5% Hafnium; 0.027% Carbon; 0.015% Boron; and 0.06% Zirconium; the balance being nickel and impurities). The table 38 includes a plurality of columns 40 for the following properties: percentage of gamma prime formers; percentage of eta prime formers; density (grams per centimeter cubed); a measure ($\Delta\sigma$) of the contribution from solid solution strengthening of the gamma phase on yield strength (in MPa), as proposed by Roth et al in H. A. Roth et al, (1997), *Met. Trans.,* 28A (δ), pp. 1329-1335; ratio of the atomic percentages of chromium and titanium (Cr/Ti in at. %); and the ratio of the atomic percentages of chromium and the sum of molybdenum and tungsten (Cr/Mo+W in at. %). The table 38 also includes a row 42 for the alloy A, a row 44 for the alloy B, a row 46 for the alloy C, a row 48 for the alloy RR1000.

Alloy A has 12.85% of gamma prime formers, 6.0% of eta prime formers, a density of 8.50 g/cm$^3$, a measure of gamma contribution to yield strength of 216 MPa, a Cr/Ti of 4.0, a Cr/(Mo+W) of 5.5. Alloy B has 12.80% of gamma prime formers, 5.8% of eta prime formers, a density of 8.42 g/cm$^3$, a measure of gamma contribution to yield strength of 217 MPa, a Cr/Ti of 3.9, a Cr/(Mo+W) of 5.5. Alloy C has 12.85% of gamma prime formers, 6.0% of eta prime formers, a density of 8.45 g/cm$^3$, a measure of gamma contribution to yield strength of 214 MPa, a Cr/Ti of 4.1, a Cr/(Mo+W) of 5.9. Alloy RR1000 has 11.28% of gamma prime formers, 4.9% of eta prime formers, a density of 8.21 g/cm$^3$, a measure of gamma contribution to yield strength of 230 MPa, a Cr/Ti of 3.8, a Cr/(Mo+W) of 5.5.

FIG. 4 illustrates a graph 50 of median metal loss for alloy C and alloy RR1000 at seven hundred degrees Celsius in air-300 vpm sulphur dioxide and salt concentration of 1.5 micrograms per square centimeter per hour. The graph 50 includes a vertical axis 52 for median metal loss in micrometers, and a horizontal axis 54 for the type of alloy.

The alloy RR1000 has two bars 56 and 58 for two hundred hours and five hundred hours respectively. The first bar 56 has a height of approximately 3.7 micrometers and the second bar 58 has a height of approximately 4.2 micrometers.

Alloy C has two bars 60, 62 for two hundred hours and five hundred hours respectively. The first bar 60 has a height of approximately 3.9 micrometers and the second bar 62 has a height of approximately 3.1 micrometers.

Figure 5:
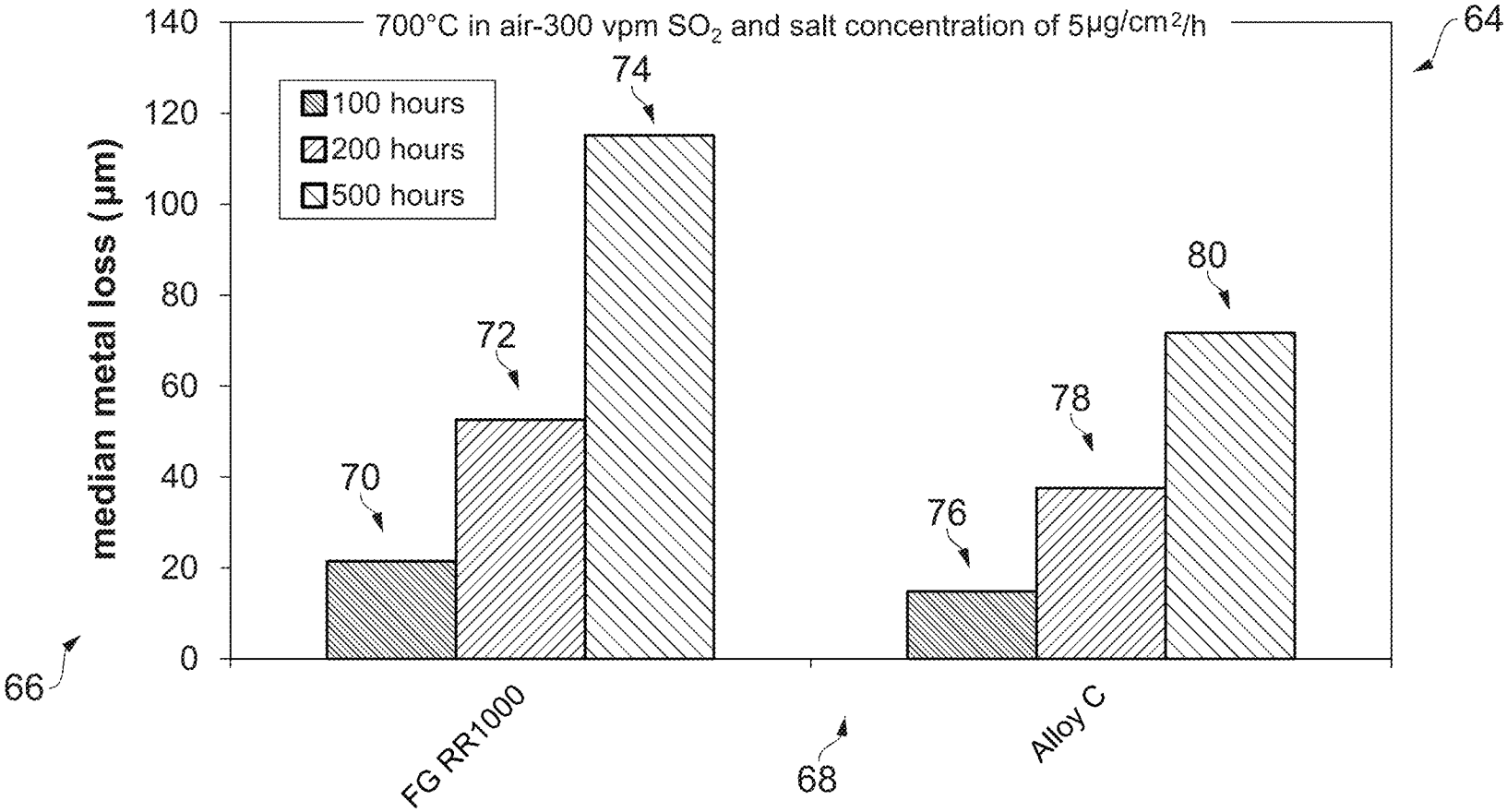
FIG. 5 illustrates another graph of median metal loss for alloy C and alloy RR1000.

FIG. 5 illustrates another graph 64 of median metal loss for alloy C and alloy RR1000 at seven hundred degrees Celsius in air-300 vpm sulphur dioxide and salt concentration of 5 micrograms per square centimeter per hour. The graph 64 includes a vertical axis 66 for median metal loss in micrometers, and a horizontal axis 68 for the type of alloy.

The alloy RR1000 has three bars 70, 72, 74 for one hundred hours, two hundred hours and five hundred hours respectively. The first bar 70 has a height of approximately 21 micrometers, the second bar 72 has a height of approximately 53 micrometers, and the third bar 74 has a height of approximately 115 micrometers.

Alloy C has three bars 76, 78, 80 for one hundred hours, two hundred hours and five hundred hours respectively. The first bar 76 has a height of approximately 15 micrometers, the second bar 78 has a height of approximately 38 micrometers, and the third bar 80 has a height of approximately 72 micrometers.

The graphs 50, 64 in FIGS. 4 and 5 show the results of laboratory hot corrosion testing. This testing was undertaken at 700° C., which is understood to produce the most severe type II hot corrosion damage. Samples are first sprayed with salt of composition of 98% $Na_2SO_4$ and 2% NaCl and then exposed in an air-300 vpm $SO_2$ environment. A specified dose of salt is applied every 50 hours. The results of two levels of salt concentration are shown. The first concentration level, of 1.5 μg/cm$^2$/h, (FIG. 4) is considered to produce representative corrosion damage. The second level, of 5 μg/cm$^2$/h (FIG. 5), is more severe/aggressive.

Corrosion damage is characterised by metal losses, i.e. the depth of corrosion damage at the mid-height location of a cylindrical sample that is ten millimeters in diameter and ten millimeters long. The metal loss data shown in the graphs 50, 64 below are the median values from measurements taken from 24 positions around the circumference of the samples. Data for alloy C is compared with data for powder nickel disc alloy RR1000. It should be appreciated from the graphs that alloy C shows lower metal loss data than alloy RR1000, which indicates that alloy C shows improved resistance to hot corrosion.

Figure 6A:
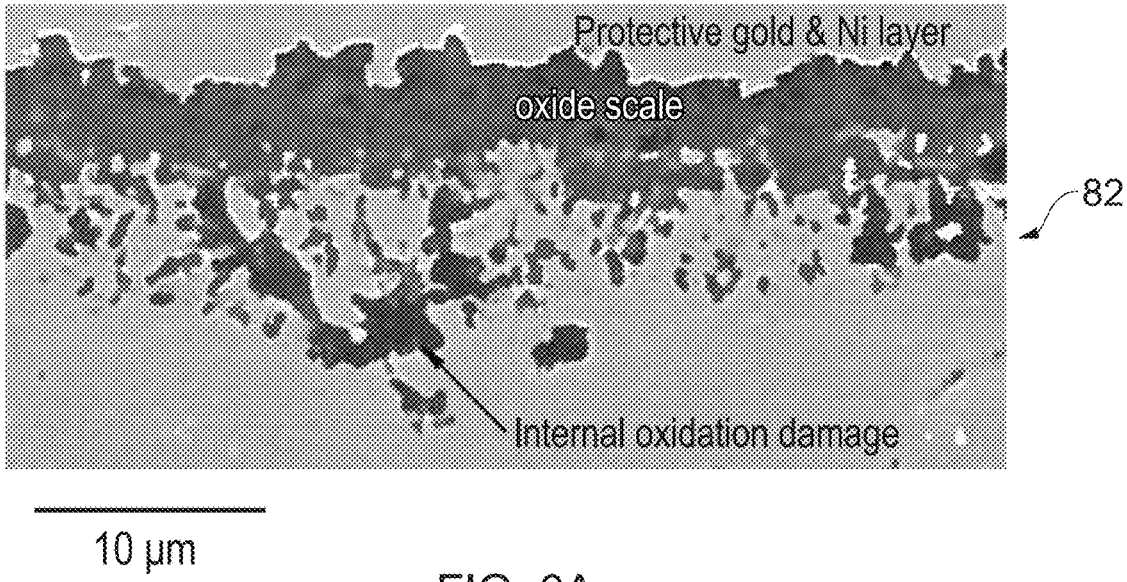
FIG. 6A illustrates a cross section of alloy RR1000 with oxidation damage.
Figure 6B:
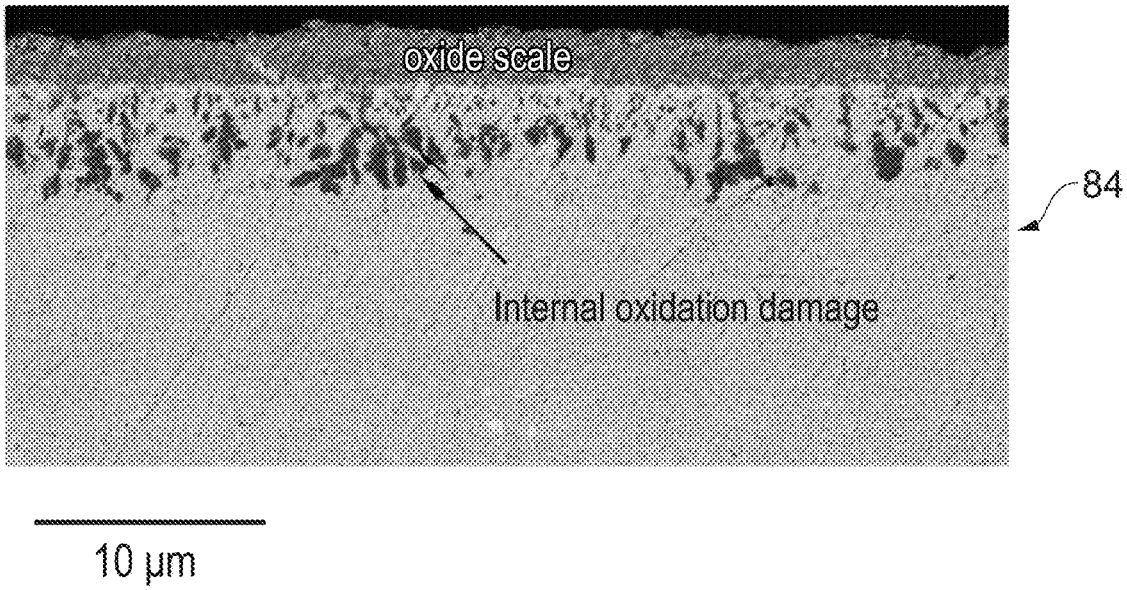
FIG. 6B illustrates a cross section of alloy C with oxidation damage.

FIG. 6A illustrates a backscattered electron image 82 of oxidation damage after 1000 hours at 800° C. in coarse grain (CG) RR1000. FIG. 6B illustrates a backscattered electron image 84 of oxidation damage after 1000 hours at 800° C. in alloy C.

FIG. 7 illustrates a table 86 of oxidation damage parameters for alloy RR1000 and alloy C. Average values of oxidation damage were obtained from 50 measurements, taken from 10 images, such as those in FIGS. 6A and 6B. Data are shown for coarse grain (CG) RR1000 and alloy C samples with prior polished surfaces. The CG RR1000 has a scale of 5.8 (±1.2) micrometers and an internal oxide of 13.7 (±1.6) micrometers. Alloy C has a scale of 2.4 (±0.3) micrometers and an internal oxide of 4.9 (±1.0) micrometers.

The resistance to oxidation damage may be characterised by measuring the depth of oxide scale (predominantly chromia, $Cr_2O_3$, and rutile, $TiO_2$) and internal oxide (alumina, $Al_2O_3$). In FIGS. 6A, 6B, images from a scanning electron microscope are shown for polished sections from samples, which received 1000 hours exposure in a laboratory furnace at 800° C. Prior to exposure, the surfaces of these coarse grain RR1000 and alloy C samples were polished. The images show that the depth of oxidation damage in alloy C is smaller than that for RR1000, indicating improved oxidation resistance for alloy C. This is quantified in the table 86 from average values of oxidation damage that have been determined from 50 measurements, from 10 images, such as those in FIGS. 6A, 6B.

Rates of time dependent crack growth, i.e. the change in crack length (a) with time (t), da/dt, have been measured using square section test pieces with a small notch in one corner, from which the crack is grown. Crack growth (da/dt) rates are calculated from crack growth data (crack growth versus cycles) that are generated in laboratory air using dwell fatigue cycles.

Dwell fatigue cycles have a period of sustained load at the maximum load value. Fatigue cycles are excursions between minimum and maximum loads. The duration of the dwell period at maximum load is selected so as to produce a fully intergranular crack growth mechanism, i.e. cracking of grain boundaries, which is a characteristic feature of time dependent crack growth. Rates of crack growth (da/dt) are correlated against the maximum stress intensity factor, $K_{max}$, which is driving force parameter that describes crack tip stresses and is calculated from the measured crack length, the nominal maximum stress and a compliance function, which describes the geometry of the crack in relation to the test piece.

The material with the lowest da/dt values shows the best resistance to time dependent crack growth.

Alloy C has time dependent crack growth rates (da/dt) at 700° C. and a $K_{max}$ of 30 MPa√m of less than $1.1\times10^{-9}$ m/s. The inventor expects Alloy A and B to show much improved resistance to time dependent crack growth. By way of comparison, coarse grain RR1000 has time dependent crack growth rates (da/dt) at 700° C. and a $K_{max}$ of 30 MPa√m of $6.7\times10^{-9}$ m/s.

For creep resistance, the above described alloys (that is, for alloys falling within the ranges in table 10 illustrated in FIG. 1), have a time to 0.2% creep strain at 800° C. and a starting stress of 300 MPa of at least 50 hours and a rupture life, under the same conditions of at least 300 hours.

Figure 8:
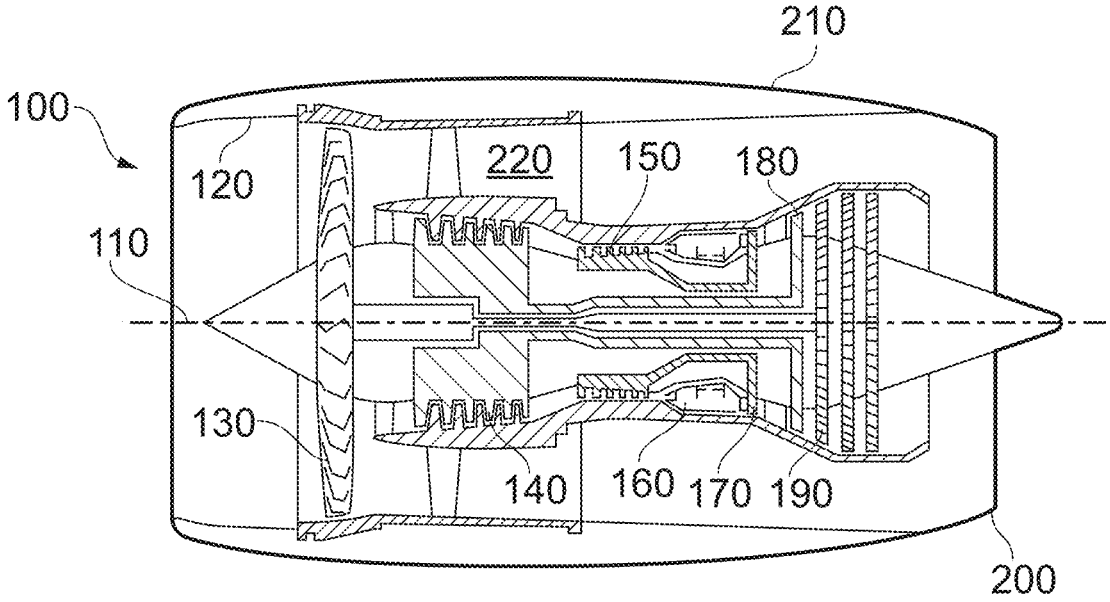
FIG. 8 illustrates a cross sectional side view of a gas turbine engine according to various examples.

FIG. 8 illustrates a cross sectional side view of a gas turbine engine 100 according to various examples. The gas turbine engine 100 has a principal and rotational axis 110 and comprises, in axial flow series, an air intake 120, a propulsive fan 130, an intermediate pressure compressor 140, a high-pressure compressor 150, combustion equipment 160, a high-pressure turbine 170, an intermediate pressure turbine 180, a low-pressure turbine 190 and an exhaust nozzle 200. A nacelle 210 generally surrounds the engine 100 and defines both the intake 120 and the exhaust nozzle 200. The gas turbine engine 100 comprises one or more of the superalloys described in the preceding paragraphs. For example, a compressor disc and/or a turbine disc of the gas turbine engine 100 may comprise one or more of the superalloys described in the preceding paragraphs (such as any of the superalloys A, B or C).

The gas turbine engine 100 operates so that air entering the intake 120 is accelerated by the fan 130 to produce two air flows: a first air flow into the intermediate pressure compressor 140 and a second air flow which passes through a bypass duct 220 to provide propulsive thrust. The intermediate pressure compressor 140 compresses the air flow directed into it before delivering that air to the high pressure compressor 150 where further compression takes place.

The compressed air exhausted from the high-pressure compressor 150 is directed into the combustion equipment 160 where it is mixed with fuel and the mixture combusted. The resultant hot combustion products then expand through, and thereby drive the high, intermediate and low-pressure turbines 170, 180, 190 before being exhausted through the nozzle 200 to provide additional propulsive thrust. The high 170, intermediate 180 and low 190 pressure turbines drive respectively the high pressure compressor 150, intermediate pressure compressor 140 and fan 130, each by suitable interconnecting shaft.

Other gas turbine engines to which the present disclosure may be applied may have alternative configurations. By way of example, such engines may have an alternative number of interconnecting shafts (e.g. two) and/or an alternative number of compressors and/or turbines. Further the engine may comprise a gearbox provided in the drive train from a turbine to a compressor and/or fan.

Figure 9:
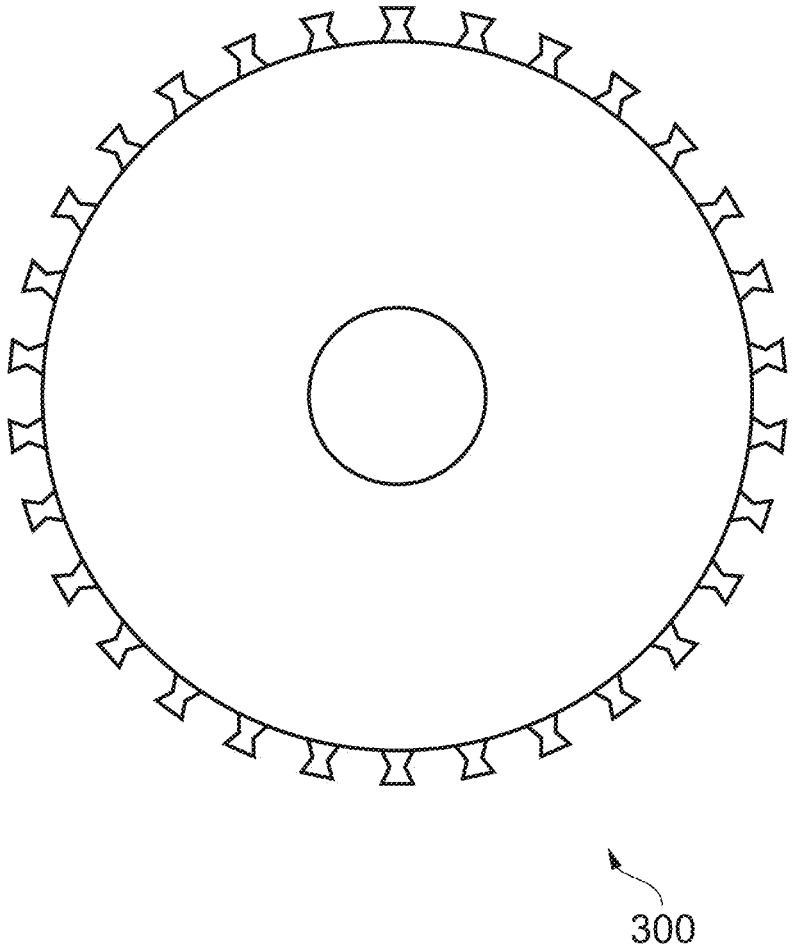
FIG. 9 illustrates a side view of a component of a gas turbine engine according to various examples.

FIG. 9 illustrates a side view of a component 300 of a gas turbine engine according to various examples. The component 300 comprises one or more of the superalloys described in the preceding paragraphs (such as an alloy falling within the ranges in table 10 illustrated in FIG. 1, or any of the superalloys A, B or C). The component 300 may be a turbine disc, or a compressor disc. In other examples (not illustrated in the figures), the component 300 may be a turbine casing, a combustor casing, or any other component of a gas turbine engine.

The component 300 (and particularly gas turbine engine disc rotors) may be manufactured according to the following process.

The above described superalloys may be produced using powder metallurgy technology, such that small powder particles (less than 53 μm in size) from inert gas atomisation are consolidated in a stainless steel container using hot isostatic pressing or hot compaction and then extruded or hot worked to produce fine grain size billet (less than 4 μm in size). Increments may be cut from these billets and forged under isothermal conditions. Appropriate forging temperatures, strains and strain rates and heating rates during solution heat treatment are used to achieve an average grain size of ASTM 8 to 7 (22-32 μm) following solution heat treatment above the gamma prime solvus temperature.

To generate the required balance of properties in the above described superalloys, the following heat treatment may be performed:

1. One process is to solution heat treat the forging above the gamma prime solvus temperature to grow the grain size to the required average grain size of ASTM 8 to 7 (22-32 μm) throughout. Appropriate forging conditions, levels of deformation and heating rates in solution heat treatment are used to achieve the required average grain size and prevent isolated grains from growing to sizes greater than ASTM 3 (127 μm).
2. Quench the forging from the solution heat treatment temperature to room temperature using forced or fan air cooling. The resistance to dwell crack growth is optimised if the cooling rate from solution heat treatment is defined so as to produce grain boundary serrations around secondary gamma prime particles. Such serrations extend the distance for oxygen diffusion and improve the resistance to grain boundary sliding.
3. Perform a series of post-solution heat treatments. These consists of (i) a high temperature stress relief of 1-4 hours at temperatures between about 870 and 950° C., (ii) a high temperature ageing heat treatment of 1-8 hours at temperatures between about 830° C. and 870° C., and (iii) a lower temperature ageing heat treatment of 1-8 hours at temperatures between about 800° C. and 830° C. then air cool. These latter ageing heat treatments may precipitate the necessary distribution (in terms of size and location)

of tertiary gamma prime particles to optimise the resistance to time dependent crack growth.

4. If higher levels of yield stress and low cycle fatigue performance are required in the bore and diaphragm regions of the disc rotor at temperatures below 650° C., then a dual microstructure solution heat treatment may be applied to forgings to produce a fine (5-10 μm) average grain size in these regions.

The above described superalloys may provide several advantages. For example, the above described superalloys are advantageous in that they may have (relative to existing alloys): improved dwell crack growth resistance at temperatures of 600-775° C.; improved resistance to oxidation and hot corrosion damage at temperatures of 600-800° C.; improved tensile proof strength at temperatures of 20-800° C.; improved resistance to creep strain accumulation at temperatures of 650-800° C.; improved dwell fatigue endurance behaviour at temperatures above 600° C.; improved fatigue endurance behaviour at temperatures below 650° C.; precipitate levels of topologically close packed (TCP) phases during high temperature exposure up to 800° C., which produce acceptable reductions in critical material properties such as time dependent dwell crack growth resistance, tensile ductility, stress rupture endurance, levels of fracture toughness and low cycle fatigue performance.

The above described superalloys may therefore provide a range of nickel base alloys particularly suitable to produce forgings for disc rotor applications, in which resistance to time dependent crack growth is optimised. Components manufactured from these alloys may have a balance of material properties that will allow them to be used at significantly higher temperatures. In contrast to known alloys, the above described alloys achieve a better balance between resistance to time dependent crack growth, environmental degradation, and high temperature mechanical properties such as proof strength, resistance to creep strain accumulation and dwell fatigue, while maintaining a stable microstructure. This has been achieved without unacceptable compromises to density and cost. In addition, the alloys have been designed to enable the manufacture of high pressure (HP) disc rotors and drums at acceptable costs. This may permit the alloys to be used for components operating at temperatures up to 800° C., in contrast to known alloys which are limited to temperatures of 700-750° C.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

What is claimed is:

1. A nickel-base superalloy comprising, by atomic percentage:

6.55% to 7.15% aluminum;
3.3% to 3.7% titanium;
1.2% to 1.7% tantalum
0.5% to 0.6% manganese; and
0.8% to 1.0% niobium; wherein a combined atomic percentage of the aluminum, the titanium, the tantalum and the niobium in the nickel-base superalloy is between 12.65% and 13.15% to provide substantially 51% to 53% by volume of gamma prime precipitates.

2. A component of a gas turbine engine comprising the nickel-base superalloy as claimed in claim 1.

3. The nickel-base superalloy as claimed in claim 1, further comprising, by atomic percentage: 1.3% to 1.4% molybdenum.

4. The nickel-base superalloy as claimed in claim 1, further comprising, by atomic percentage: 1.0% to 1.1% iron.

* * * * *